US006060945A

United States Patent [19]

Tsay

[11] Patent Number: 6,060,945

[45] Date of Patent: May 9, 2000

[54] BURN-IN REFERENCE VOLTAGE GENERATION

[75] Inventor: Ching-yuh Tsay, Richardson, Tex.

[73] Assignee: Texas Instruments Incorporated, Dallas, Tex.

[21] Appl. No.: 08/251,054

[22] Filed: May 31, 1994

[51] Int. Cl.[7] ..... G05F 1/10

[52] U.S. Cl. ..... 327/543; 327/73; 327/541

[58] Field of Search ..... 307/296.1, 296.4, 307/296.6, 296.8, 310, 313; 327/538, 540, 543, 545, 535, 53, 54, 56, 73, 323

[56] References Cited

U.S. PATENT DOCUMENTS

| | | | |
|---|---|---|---|
| 4,899,114 | 2/1990 | Berhmer et al. | 327/73 |
| 5,043,652 | 8/1991 | Rybicki et al. | 327/535 |
| 5,063,304 | 11/1991 | Iyengar | 307/296.6 |
| 5,087,834 | 2/1992 | Tsay | 307/443 |
| 5,087,891 | 2/1992 | Cytera | 307/196.8 |
| 5,103,159 | 4/1992 | Breugnot et al. | 323/315 |
| 5,120,993 | 6/1992 | Tsay et al. | 307/296.4 |
| 5,159,206 | 10/1992 | Tsay et al. | 307/272.3 |
| 5,168,209 | 12/1992 | Thiel | 323/313 |
| 5,220,534 | 6/1993 | Redwine et al. | 365/226 |
| 5,233,161 | 8/1993 | Farwell et al. | 219/209 |
| 5,235,222 | 8/1993 | Kondoh et al. | 307/296.8 |
| 5,280,234 | 1/1994 | Huang et al. | 307/296.8 |
| 5,300,837 | 4/1994 | Fischer | 307/296.6 |

*Primary Examiner*—Jung Ho Kim
*Attorney, Agent, or Firm*—W. Daniel Swayze, Jr.; Wade James Brady, III; Frederick J. Telecky, Jr.

[57] ABSTRACT

A circuit to provide a burn-in reference voltage that is stable with respect to temperature and manufacture. The burn-in reference voltage circuit produces a burn-in reference voltage related to an external reference voltage. The circuit includes a feedback circuit to produce a feedback voltage that tends to the internal reference voltage in response to a deviation of the feedback voltage, from the internal voltage. The feedback voltage is mirrored to produce a mirrored voltage having the same magnitude as the feedback voltage but measured with respect to the external reference voltage.

8 Claims, 2 Drawing Sheets

BURN-IN REFERENCE VOLTAGE GENERATION

TECHNICAL FIELD OF THE INVENTION

This invention is in the field of integrated circuits and more particularly directed to on chip power supply control.

BACKGROUND OF THE INVENTION

In recent years, the density of components that is integrated into single integrated circuit design has increased at a high rate. Example of such high density circuits include dynamic random access memories DRAMS, which are now being fabricated at 16 megabit single-chip densities. In order to accomplish such complexities while maintaining the size of the chip at reasonable and manufacturable levels, the minimum feature size transistors and other components must of course be reduced For DRAM devices which have generally been the most densely integrated devices in the industry, the size of features such as MOS transistor gates is generally at the smallest size manufacturable by available technology. In the example of 16 MBIT DRAM devices, transistor gate lengths are expected to be in the range of 0.5 to 0.7 microns.

It is well known that MOS transistors which have gate widths and accordingly transistor channel lengths which are of sub-micron dimensions are subject to time and voltage dependent phenomena to which larger transistors are not subject. An example of such phenomena is transistor performance degradation due to channel hot-carrier effects. While certain techniques are available to reduce the susceptibility of transistors to channel hot-carrier effects, such as providing graded junctions as described in U.S. Pat. No. 4,356,623 issued and assigned to Texas Instruments Incorporated, the drain to source voltage nominally applied to the transistor structure remains a strong factor in the channel hot-carrier degradation of the transistor performance.

Further, the storage element in DRAMS is commonly a thin film capacitor. It is well known that the data stored in DRAM capacitors may be upset by naturally occurring alpha particles. The degree to which data is lost in such events depends upon a capacitance of the memory cell and accordingly the capacity of modern DRAM cells is generally maintained above 35 fF for each cell and preferably above 50 fF. Since it is desirable that the density of storage cells per unit area should be as large as possible, in order to maintain the necessary storage capacitance of 35 to 50 fF, the thickness of the capacitor dielectric must be reduced. Modern storage capacitors have dielectric thicknesses on the order of the equivalent 10 nm of silicon dioxide or less. However, with such thin capacitor dielectrics, both dielectric breakdown voltage and time-dependent dielectric breakdown rates degrade with thinner dielectrics, assuming a constant voltage applied there across.

For these reasons, the power supply voltage applied to such high density VLSI devices including DRAMS, other memories and logic devices are preferably reduced as the feature sizes decrease. In addition, since the power dissipation of the chip increases with increasing number of components integrated into the chip, a reduced power supply voltage would also reduce the power supply dissipation. Many other circuits may still use a higher power supply voltage, for example 5 volts nominally, then it's desired by the high density components described above, for example, 3.3 volts which makes the designer of systems incorporating these devices reluctant to provide an additional power supply in the system, due to the cost of such other supplies and the routing of an additional bias voltage.

It should be noted that it is desirable that the performance of the integrated circuit should not vary strongly with power supply voltage applied thereto, as such variation may increase the cost of production and testing of the chip during its manufacture, but such variation may also cause system-level problems for the user.

Furthermore, in the field of DRAM devices, due to the large amount of tbin capacitor dielectric on each device, manufactures generally perform a "burn-in" operation during the test process of the chips. Burn-in is intended to stress the devices, both by voltage and by temperature so that weak devices are removed from the population which is shipped to the user of the devices, for example, removing the "infant mortality" portion of the reliability curve. On chip regulation of the bias voltage for the memory array, for example will preclude the direct application of power supply voltage to the capacitors. Hence another means of providing the burn-in voltage to the capacitors must be provided.

There are known current sources made with a field effect transistor and with a bias voltage source that is used to control the gate of the transistor. The reference or bias source voltage may be of the so called "bandgap" type. The term "bandgap" refers to the energy interval between the valance bands and the conduction bands of the semiconductor. Sources of this type use the known relationship of the dependency between the energy interval and the temperature to achieve compensation that makes the reference voltage as stable as possible as a function of temperature.

The voltage source of this bandgap generally has two diodes through which different current flows (or the same currents), but in this case the diodes are obligatorily ones with different junction surfaces, and a loop differential amplifier amplifying the voltage difference at the terminals and applying the diodes with current.

All bandgap references use the same underlying principle in that they generate a voltage proportional to the absolute temperature ($V_{PTAT}$) which has a positive temperature coefficient. These bandgap voltages combine this voltage with a base-emitter voltage of the transistor, which has a negative temperature coefficient. When properly combined, for example with proper weighting, the two temperature coefficients cancel one another and results in a voltage that is fairly independent of temperature. This voltage is typically around 1.23 volts and is close to the bandgap voltage of silicon. Known bandgap architectures include those disclosed in U.S. Pat. Nos. 4,249,122, 4,447,784 and 3,887,863.

Furthermore, accelerated voltage testing is currently used in DRAM testing to eliminate early failure of devices and to guarantee that these devices are reliable. However, DRAM circuits also have generally a fixed life time and a device which has been over-stressed during testing will have a shorter useful lifetime. Hence, the accelerated voltage that is applied to the devices needs to be precise to prevent under stressing and over stressing. Since the testing are performed at both high and low temperatures, this accelerated voltage also needs to be constant over temperature variations. The prior art has not provided devices with this precise accelerated voltage at both high and low temperatures. As illustrated by FIG. 1, the accelerated voltage is designed to be 2.4 volts below the external voltage, nominally $V_{EXT}$=8 volts. This accelerated voltage of 5.6 volts is generated by 3 P-channel transistors connected in series to provide a total voltage drop of 2.4 volts from the 8.0 volts $V_{EXT}$ supply. As illustrated in FIG. 2, a bias voltage $V_{BIAS}$ is converted to another voltage at node 108, the voltage at node 108 is applied to the gate of N-channel transistor 106 to induce a small current through the N-channel transistor 106 through the drain to source of the transistor 106. Each of the P-channel transistors 100, 102 and 104 are turned on and the voltage drop across each of these transistors is approximately above the threshold voltage of each of these transistors resulting in a voltage at node 110 to be approximately 5.6 volts. As a consequence of using three P-channel transistors to provide the voltage drop of 2.4 volts, any variation in the threshold voltage of the P-channel transistors 100, 102 and 104 is tripled Furthermore, any variation in threshold voltages of these P-channel transistors as a result of temperature variation is also tripled due to the series connection of these P-channels transistors. Thus, the circuit illustrated in FIG. 2 does not provide good temperature performance and good process performance.

FIG. 3 illustrates another circuit attempting to generate a proper burn-in reference voltage. The circuit of FIG. 3 generates a reference voltage through threshold voltage differences. The reference voltage is connected to a closed loop op-amp circuit to raise the voltage to a desired level.

P-channel transistors 120, 122 and 124 and N-channel transistor 125 are used to generate two biasing voltages, namely $V_{BIASI}$ and $V_{BIASN}$ from $V_{EXT}$. These two biasing voltages $V_{BISI}$ and $V_{BIASN}$ are applied to the gates of to P-channel transistor 126 and N-channel transistor 129 respectively, to assure that the same reference current flows through P-channel transistors 126, 128 and 130 while the current through transistor 129 is doubled the original reference current, forcing the same current to flow through P-channel transistors 132 and 134. Thus, since P-channel transistors 128, 130, 132 and 134 respectively all have the same size and same current under the same electrical configuration, all these four transistors have the same $V_{GST}=V_{GS-VT}$. Since the four transistors are dioded connected, the source to drain voltage drop across each transistor is $V_{DS}=V_{GS}=V_{GST}+V_T$. Because transistors 132 and 134 have a larger $V_T$, the voltage difference between $V_{EXT}$ and the voltage at node 142, the same as the voltage difference between the total voltage drop across transistors 132 and 134 and the total voltage drop across transistors 128 and 130 is two times $(V_{T1}-V_{T2})$ where $V_T$, is the threshold voltage of transistors 132 and 134 and $V_{T2}$ is the threshold voltage of transistors 128 and 130. A closed loop op-amp is used as a multiplier to force the voltage on node 140, REFO, to be approximately the same as that on node 142 hence, $V_{R1}=V_{EXT}-V_{REFO}$ and $V_{EXT}-\text{REFO}\approx 2 * (V_T-V_{T2})$. The Current through $R_1$ and $R_2$ is ($V_{EXT}$–REFO/R1. The voltage drop across $R_1$ and $R_2$ is equal to current $R_1\times(R_1+R_2)$. Therefore the voltage drop is equal to $$(R_1 + R_2) * \frac{\text{VEXT} - \text{REFO}}{R_1}$$

Therefore, the output voltage of the multiplier is $V_{REFBI}$, where $V_{REFBI}$ equals $V_{EXT}-((R_2+R_1)/R_1) * 2* (V_{T1}-V_{T2})$. Thus by adjusting the ratio of resistance R1, of resistor 136 and the resistance R2 of resistor 138 a desired $V_{REFBI}$ can be obtained. A serious disadvantage of the above approach is the need of a dedicated reference voltage calling for additional masks to produce transistors with different threshold voltages and additional testing of this circuit and on-chip trying of resistors 136 or 138.

SUMMARY OF THE INVENTION

The present invention provides a circuit to generate a burn-in reference voltage with respect to $V_{EXT}$ that is both stable with respect to temperature and process. The present invention includes a memory device for producing a burn-in reference voltage, including an internal reference generator circuit for producing an internal reference voltage, ($V_{REF}$) an external reference generator circuit for producing an external reference voltage, a ($V_{EXT}$) feedback circuit coupled to the internal reference generator circuit to produce a feedback voltage having changes in the feedback voltage from the internal reference voltage, the feedback circuit being responsive to the changes in the feedback voltage to adjust the feedback voltage toward the internal reference voltage as the feedback voltage related to the internal reference voltage, a mirroring circuit coupled to the feedback circuit and the external reference generator circuit to produce the burn-in reference voltage by receiving the feedback voltage and mirroring the feedback voltage to produce a voltage having a mirrored magnitude the approximately same as the feedback voltage and the mirrored magnitude of the mirrored voltage being measured with respect to the external reference voltage.

DESCRIPTION OF THE DRAWINGS

These and other features of the invention will be apparent to those skilled in the art from the following detailed description of the invention taken together with the accompanying drawings, in which.

DETAILED DESCRIPTION OF THE INVENTION

The present invention and its advantages are understood by referring to FIGS. 1–5 of the drawings, like numerals being used for like and corresponding parts of the various drawings.

Figure 1:
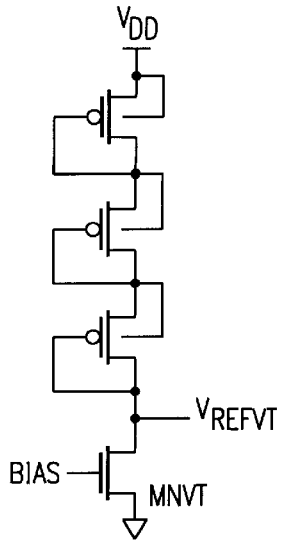
FIG. 1 illustrates a burn-in reference voltage circuit with a series of P-channel transistors.
Figure 2:
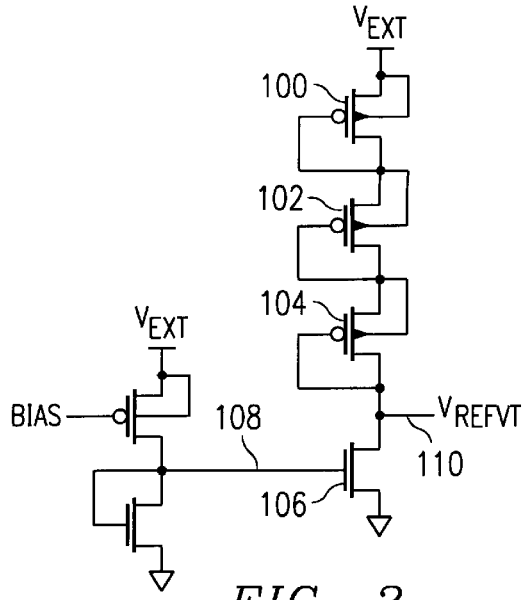
FIG. 2 illustrates a further burn-in reference voltage circuit with a series of P-channel transistors and its biasing circuits.
Figure 3:
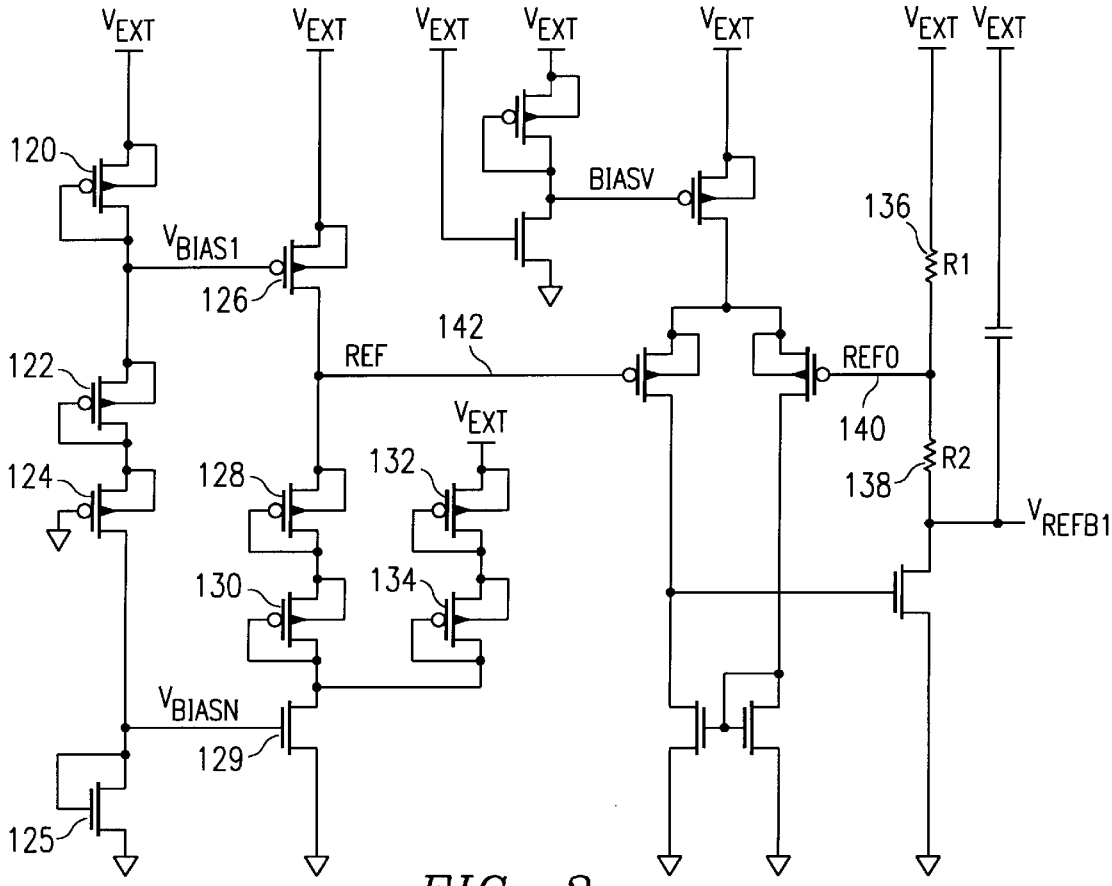
FIG. 3 illustrates a further burn-in reference voltage circuit based on threshold voltage difference.
Figure 4:
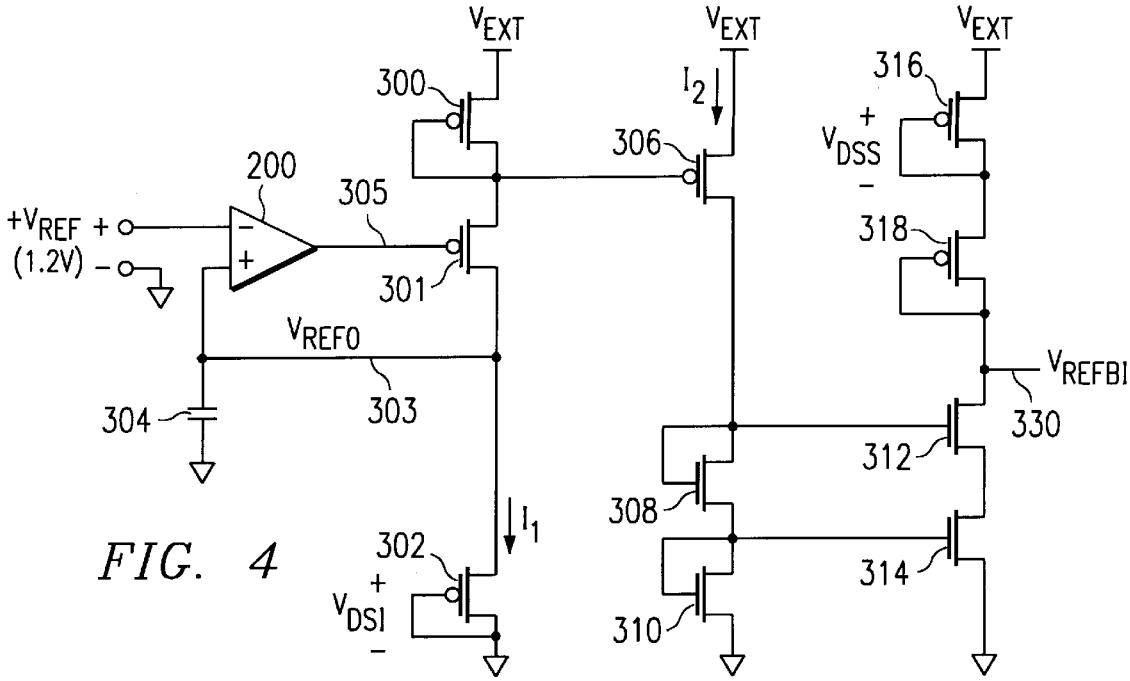
FIG. 4 illustrates a burn-in reference voltage circuit of the present invention employing a multiplier circuit and a known reference voltage.

FIG. 4 illustrates that comparator 200 is connected to the internal reference voltage $V_{REF}$. For example, 1.2 volts which may be a bandgap reference voltage. The other input of the comparator 200 is connected to capacitor 304 to stabilize the close loop feedback circuit. The output of comparator 200 is connected to the gate of P-channel transistor 301. The drain of P-channel transistor 301 is connected to the capacitor 304 and the source of P-channel transistor 302. The source of P-channel transistor 301 is connected to both the gate and drain of P-channel transistor 300, which has its source connected to the external reference voltage, $V_{EXT}$. The gate and drain of transistor 302 is connected to ground. The voltage at node 303, $V_{REF}$, is very close to the voltage $V_{REF}$ due to the close-loop configuration of comparator 200. If the voltage $V_{REF}$ is different from the voltage $V_{REFO}$ by more than the offset voltage of comparator 200, then the feedback circuit through comparator 200 adjusts itself in order to reduce this difference. For example, if $V_{REFO}$ rises with respect to the voltage $V_{REF}$ then the voltage at node 305 rises, reducing the current through the source to drain of transistor 301 which in turn reduces the source to drain voltage across transistor 302, reducing the voltage $V_{REFO}$ at node 303. On the other hand, if the voltage $V_{REFO}$ at node 303 falls below the voltage $V_{REF}$ then the voltage at node 305 falls, increasing the current through the source to drain of transistor 301, which in turn increases the voltage $V_{REFO}$ at node 303. Thus, the voltage difference between $V_{REF}$ and $V_{REFO}$ is small, for example, 10 to 20 millivolts. Thus, the source to gate voltage of transistor 302 is very close to 1.2 volts.

However, the voltage of $V_{REF}$ is with respect to ground and not with respect to the voltage $V_{EXT}$. In order, to generate a stable voltage for burn-in, the voltage should be with respect to the voltage $V_{EXT}$. Therefore, a circuit to convert a reference with respect to ground to a reference with respect to $V_{EXT}$ is needed. If the physical characteristics of P-channel transistors 316 and 318 in FIG. 4 are the same for example the length and width as that of transistor 302, and if the current is the same through transistors 302, 316 and 318, the voltage drop will also be the same. Thus, mapping the current through transistor 302 to the transistors 316 and 318 results in the reference burn-in voltage, $V_{REFBI}$, being with respect to the external voltage, $V_{EXT}$.

P-channel transistor 306 has the gate of transistor 306 connected to the drain and gate of transistor 300. The source of transistor 306 is connected to the voltage $V_{EXT}$. The drain of transistor 306 is connected to the gate and drain of N-channel transistor 308, which has the source of transistor 308 connected to the gate and drain of N-channel transistor 310, which has its source connected to ground. The gate and drain of transistor 308 is connected to the gate of N-channel transistor 312. The gate and drain of transistor 310 is connected to the gate of N-channel transistor 314. The source of transistor 314 is connected to ground and the source of transistor 312 is connected to the drain of transistor 314. The drain of transistor 312 is connected to the gate and drain of P-channel transistor 318. The source of transistor 318 is connected to the gate and drain of P-channel transistor 316. The source of P-channel transistor 316 is connected to the voltage $V_{EXT}$.

Since there is no current in and out of comparator 200, the same current $I_1$ is forced by comparator 200 to flow through the sources and drains of transistors 300, 301 and 302. Also because transistors 300 and 306 are of the same type, both are biased in saturation region, the connection between their gates results in same gate to source voltage resulting in the currents through the transistors being rationed according to the ratio of the sizes of those transistors. Hence, the current $I_1$ is "mirrored" to transistors 306, 308 and 310 as $I_2$. By meeting the same criteria as above, the current $I_2$ is mirrored through transistors 308 and 310 to transistors 312 and 314. Since the current through transistors 316 and 318 is the same as the current through transistors 312 and 314, by choosing proper transistor sizing the final current that is mirrored to transistors 316 and 318 can be adjusted to be the same as the current $I_1$.

Thus, since the current through transistors 316 and 318 is the same current through transistor 302 and the transistors 316, 318 and 302 are of the same size, the voltage drop across each transistor 316 and 318 is the same voltage drop across transistor 302. Thus, since the voltage drop across transistor 302 is approximately 1.2 volts, the voltage at the drain of transistor 318 at node 330 is 2.4 volts with the respect to the voltage $V_{EXT}$ and provides a stable voltage of 5.6 volts for burn-in testing when $V_{EXT}$ is set to 8.0 volts.

Figure 5:
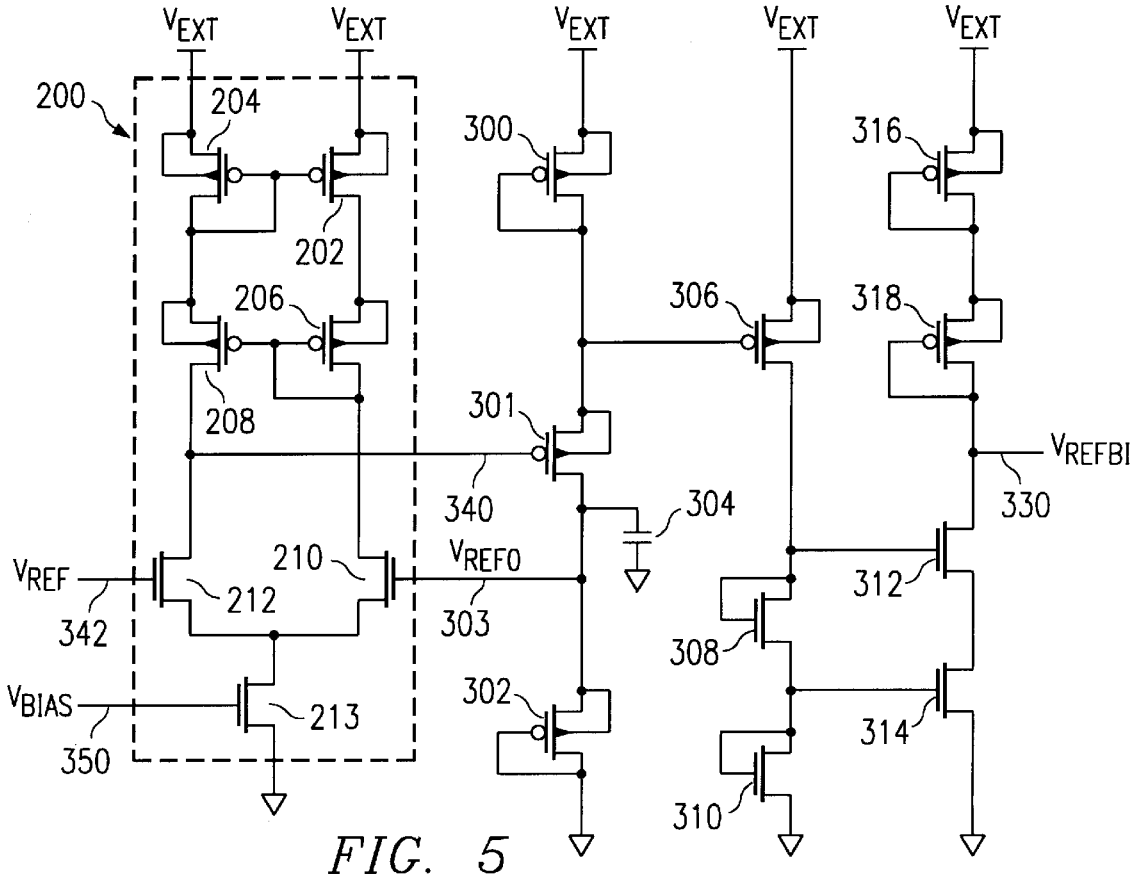
FIG. 5 illustrates another embodiment of the burn-in reference voltage circuit of the present invention.

FIG. 5. illustrates another embodiment of the invention where the comparator 200 includes channel transistors 202, 204, 206 and 208 and N-channel transistors 210, 212 and 213. The gate of N-channel transistor 213 is connected to node 350 biased by $V_{BIAS}$. The drain of transistor 213 is connected to the sources of N-channel transistors 210 and 212. The gate of transistor 212 is connected to a voltage level $V_{REF}$ at node 342 while the gate of transistor 210 is connected to a voltage level $V_{REFO}$ at node 303. The drain of transistor 210 is connected to the gate and drain of P-channel transistor 206. The drain of transistor 212 is connected to the gate of transistor 301 and the drain of P-channel transistor 208. The substrate of transistors 206 and 208 are connected to the source of the respective transistors. The source of transistor 206 is connected to the drain of P-channel transistor 202. The substrate of transistor 202, is connected to the source of transistor 202 which is connected to the voltage $V_{EXT}$. The gate of transistor 208 is connected to the gate of transistor 206, and the source of transistor 208 is connected to the substrate of transistor 208. The source of transistor 208 is connected to the gate and drain of P-channel transistor 204. The substrate of transistor 204 is connected to the source of transistor 204, and the source of transistor 204 is connected to the voltage $V_{EXT}$. The gate of transistor 204 is connected to the gate of transistor 202.

In operation, comparator 200 is enabled by the voltage $V_{BIAS}$ being at DC biasing level larger than the threshold voltage of N-channel transistor, $V_{TN}$ and being applied to the gate of transistor 213. With voltage at the gate of transistor 213 higher than $V_{TN}$, transistor 213 is turned on and acts as a current source to ground. The sources of transistors 210 and 212 are pulled by transistor 213 to a voltage which is an N-channel threshold voltage $V_{TN}$ below the gate voltages of 210 and 212. This allows transistors 210 and 212 to be conductive/responsive to voltages applied to their respective gates, enabling the operation of comparator 200 to be responsive to the differential voltage between node 303 and node 342 by adjusting the voltage at node 340. As noted above, transistor 213 acts as a current source in comparator 200. As input voltage to node 342 ($V_{ref}$) is below voltage of node 303, transistor 210 will become more conductive than will transistor 212, as a result of the matching of size of transistors 210 and 212. Accordingly, the bulk of the current through the source of transistor 213 will be drawn by transistors 202, 206 and 210 rather than by transistors 204, 208 and 212 and it is preferable that transistors 204 and 208 and transistors 202 and 206 be closely match to one another respectively and that transistors 210 and 212 also be closely matched to one another. In order to satisfy the transistor current-voltage relationships, the high current passing through transistors 202 and 206 relative to transistors 204 and 208 will cause the voltage at the drain of transistor 208 to rise toward $V_{EXT}$ and will cause the voltage at the drain of transistor 206 to fall toward ground. With the drains of transistors 208 and 212 at node 340 rising toward $V_{EXT}$, transistor 301 will become less conductive, pulling node 303 toward ground. As node 303 is pulled toward ground, transistor 210 will tend to conduct less current. This in turn will draw less current through transistors 202 and 206 and more through transistors 204 and 208 which in turn will cause the voltage at the drains of transistor 208 and 212 at node 340 to fall toward ground as the current through these transistors are raised. Transistor 301 becomes more conductive with the lower voltage at node 340 as discussed above, and it is preferable that transistors 204 and 208 and transistors 202 and 206 be closely match to one another respectively and that transistors 210 and 212 also be closely matched to one another. With that matching of the transistor pairs, the operation of comparator 200 will tend toward a point where the current passing through transistors 204, 208 and 212 will match the current passing through transistors 202, 206 and 210, with the gate to source voltages of transistors 210 and 212 becoming equal. Accordingly, comparator 200 will be in a steady state, reaching the operation where the voltage at node 342 is equal to the voltage at node 303. The source coupled pair transistors 210 and 212 compares the voltage of node 342 and node 303. Differential voltages cause differential current flows in transistors 210 and 212, thus, varying the potential at node 340. For example, as the voltage at node 342 is higher than the voltage at node 303, the current in transistors 204, 208 and 212 increases. As the current increases, the voltage at node 340 drops lower. Thus, node 340 is used as a feedback to correct the potential at node 303. As the voltage at node 342 drops, the voltage at node 303 also decreases to match the voltage at node 342.

A proper voltage level, $V_{BIAS}$, is applied to the gate of transistor 213 to produce a current source for comparator 200.

Since there is no current in and out of comparator 200, the same current $I_1$ is forced by comparator 200 to flow through the sources and drains of transistors 200, 301 and 302. Also because transistors 300 and 306 are of the same type, both are biased in saturation region, the connection between their gates results in same gate to source voltage resulting in the currents through the transistors being rationed according to the ration of the sizes of those transistors. Hence, the current $I_1$ is "mirrored" to transistors 306, 308 and 310 as $I_2$. By meeting the same criteria as above, the current $I_2$ is mirrored through transistors 308 and 310 to transistors 312 and 314. Since the current through transistors 316 and 318 is the same as the current thru transistors 312 and 314, by choosing proper transistor sizing the final current that is mirrored to transistors 316 and 318 can be adjusted to be the same as the current $I_1$.

Thus, since the current through transistors 316 and 318 is the same current through transistor 302 and the transistors 316, 318 and 302 are of the same size, the voltage drop across each transistor 316 and 318 is the same voltage drop across transistor 302. Thus, since the voltage drop across transistor 302 is approximately 1.2 volts, the voltage at the drain of transistor 318 at node 330 is 2.4 volts with the respect to the voltage $V_{EXT}$ and provides a stable voltage of 5.6 volts for burn-in testing at $V_{EXT}$ equals 8.0 volts.

Other Embodiments

Although the present invention and its advantages have been described in detail, it should be understood that various changes, substitutions and alterations can be made herein without departing from the spirit and scope of the invention as defined by the appended claims.

What is claimed is:

1. A memory device for producing a burn-in reference voltage, comprising:

an input circuit for receiving an internal reference voltage and an external reference voltage;

a feedback circuit coupled to said input circuit to produce a feedback voltage having deviations from said internal reference voltage, said feedback circuit being responsive to said deviations of said feedback voltage to adjust said feedback voltage toward said internal reference voltage as said feedback voltage is measured with respect to said internal reference voltage;

a mirroring circuit coupled to said feedback circuit and said input circuit to produce said burn-in reference voltage by receiving said feedback voltage and mirroring said feedback voltage to produce a mirrored voltage having a magnitude approximately the same as said feedback voltage, said mirrored voltage being measured with respect to said external reference voltage.

2. A memory device for producing a burn-in reference voltage as in claim 1, wherein said feedback circuit includes a comparator circuit for comparing said internal reference voltage and said feedback voltage.

3. A memory device for producing a burn-in reference voltage as in claim 1, wherein said mirroring circuit mirrors said feedback voltage to said mirrored voltage by producing a current in said mirroring circuit having a magnitude of a current in said feedback circuit.

4. A memory device for producing a burn-in reference voltage as in claim 3, wherein said mirroring circuit includes a transistor, said mirrored voltage is produced by flowing said current through said transistor.

5. A burn-in reference voltage circuit to produce a burn-in reference voltage, comprising:

an input circuit for receiving an internal reference voltage and for receiving an external reference voltage;

a feedback circuit coupled to said input circuit to produce a feedback voltage, said feedback circuit being operative to adjust said feedback voltage toward said internal reference voltage in response to changes in said feedback voltage with respect to said internal reference voltage;

a mirroring circuit coupled to said feedback circuit to produce said burn-in reference voltage by receiving said feedback voltage and mirroring said feedback voltage to produce a mirrored voltage being approximately the same as said feedback voltage, said mirrored voltage being measured with respect to said external reference voltage.

6. A burn-in reference voltage circuit to produce a burn-in reference voltage as in claim 5, wherein said feedback circuit includes a comparator circuit for comparing said internal reference voltage and said feedback voltage.

7. A burn-in reference voltage circuit to produce a burn-in reference voltage as in claim 5, where said mirroring circuit mirrors said feedback voltage to produce said mirrored voltage by producing a current in said mirroring circuit having a magnitude of a current in said feedback circuit.

8. A burn-in reference voltage circuit to produce a burn-in reference voltage as in claim 7, wherein said mirroring circuit includes a transistor so that said mirrored voltage is produced by flowing said current through said transistor.

* * * * *